US008188827B2

(12) United States Patent
Okawa

(10) Patent No.: US 8,188,827 B2
(45) Date of Patent: May 29, 2012

(54) INDUCTOR COMPONENT

(75) Inventor: Toru Okawa, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 12/468,473

(22) Filed: May 19, 2009

(65) Prior Publication Data

US 2009/0295525 A1 Dec. 3, 2009

(30) Foreign Application Priority Data

May 29, 2008 (JP) ..... 2008-141210

(51) Int. Cl.

| | |
|---|---|
| ***H01F 5/00*** | (2006.01) |
| ***H01F 27/02*** | (2006.01) |
| ***H01F 27/29*** | (2006.01) |
| ***H01F 27/24*** | (2006.01) |

(52) U.S. Cl. ..... 336/200; 336/83; 336/192; 336/234

(58) Field of Classification Search ..... 336/83, 336/192, 200, 234

See application file for complete search history.

(56) References Cited

U.S. PATENT DOCUMENTS

| | | | | |
|---|---|---|---|---|
| 4,866,573 | A * | 9/1989 | Bernstein | 361/782 |
| 6,157,283 | A * | 12/2000 | Tsunemi | 336/192 |
| 6,950,005 | B2 * | 9/2005 | Christopherson et al. | 336/198 |
| 7,215,232 | B2 * | 5/2007 | Aoki et al. | 336/83 |
| 2007/0069844 | A1 * | 3/2007 | Kudo et al. | 336/83 |

FOREIGN PATENT DOCUMENTS

| | | | |
|---|---|---|---|
| JP | U-61-70905 | | 5/1985 |
| JP | U-62-76516 | | 5/1987 |
| JP | A-1-213017 | | 8/1989 |
| JP | A-2-97107 | | 4/1990 |
| JP | A-04-354309 | | 12/1992 |
| JP | 09270332 | A * | 10/1997 |
| JP | A-10-70429 | | 3/1998 |
| JP | A-10-312922 | | 11/1998 |
| JP | A-2000-58343 | | 2/2000 |
| JP | A-2001-93731 | | 4/2001 |
| JP | A-2001-211048 | | 8/2001 |
| JP | A-2002-289451 | | 10/2002 |
| JP | A-2007-103596 | | 4/2007 |
| JP | A-2007-115761 | | 5/2007 |
| JP | 2008091359 | A * | 4/2008 |

OTHER PUBLICATIONS

Notice of Reasons for Rejection for Japanese Application No. 2008-141210, issued on Jan. 7, 2010.

* cited by examiner

*Primary Examiner* — Elvin G Enad
*Assistant Examiner* — Tsz Chan
(74) *Attorney, Agent, or Firm* — Oliff & Berridge, PLC

(57) ABSTRACT

An inductor component has electrode portions, a winding portion in which a conductor is wound by three or more turns, and lead portions located at both ends of the winding portion and connecting the winding portion and the electrode portions. Winding intervals of the respective turns in the winding portion decrease monotonically from one end to the other end of the winding portion.

1 Claim, 11 Drawing Sheets

(a)

(b)

INDUCTOR COMPONENT

BACKGROUND OF THE INVENTION

1. Field of the Invention

The present invention relates to an inductor component.

2. Related Background Art

There is a known inductor component having electrode portions, a winding portion in which a conductor is wound by three or more turns, and lead portions located at respective ends of the winding portion and connecting the winding portion and the electrode portions (e.g., cf. Japanese Patent Application Laid-open No. 10-312922). In the inductor component described in the foregoing Laid-open No. 10-312922, winding intervals of the respective turns in the winding portion are equally-spaced intervals.

SUMMARY OF THE INVENTION

The inductor component described in Laid-open No. 10-312922 has the following problem. Since the winding intervals of the respective turns in the winding portion are equally-spaced intervals in the inductor component described in Laid-open No. 10-312922, magnetic conditions (e.g., magnetic coupling or the like) are identical between adjacent turns. Namely, when the winding portion is assumed to be an aggregate of coils (inductors) each of which is composed of two adjacent turns, magnetic path lengths of the coils are fixed throughout the entire winding portion. For this reason, there is no variation in the impedance of the conductor forming the winding portion, in a magnetic path formed by the winding portion.

In contrast to it, the impedance of the conductor significantly varies at the ends of the winding portion (winding start and winding end) for the following reason. The winding portion has the shape in which the conductor is wound, whereas the lead portions have the shape extending from the winding portion toward the corresponding electrode portions; therefore, the winding portion and the lead portions are different in structure. Therefore, structural change occurs at the ends of the winding portion. This structural change causes change in magnetic conditions at the ends of the winding portion and, therefore, the impedance of the conductor significantly varies at the ends of the winding portion. For example, the impedance increases at one end of the winding portion and the impedance further increases at the other end of the winding portion. If the impedance varies in the middle of the conductor, a signal propagating in the conductor can be reflected at the impedance-varying location, so as to cause attenuation of the signal. The reflection can also cause unwanted radiation so as to produce noise.

An object of the present invention is to provide an inductor component in which variation in impedance is suppressed and in which there occurs little reflection of a signal.

The present invention provides an inductor component comprising electrode portions, a winding portion in which a conductor is wound by three or more turns, and lead portions located at both ends of the winding portion and connected to the winding portion and the electrode portions, wherein winding intervals of the respective turns in the winding portion decrease monotonically from one end to the other end of the winding portion.

In the present invention, the winding intervals of the respective turns in the winding portion decrease monotonically from one end to the other end of the winding portion and, therefore, magnetic conditions are different between adjacent turns. Namely, when the winding portion is assumed to be an aggregate of coils (inductors) each composed of two adjacent turns, magnetic path lengths of the coils become shorter from the one end side to the other end side of the winding portion. For this reason, the impedance of the conductor forming the winding portion increases from the one end side to the other end side of the winding portion, in the magnetic path formed by the winding portion. As a consequence of this configuration, the impedance is prevented from suddenly varying at the other end of the winding portion though the impedance inevitably varies at the one end of the winding portion. The present invention suppresses, particularly, the sudden variation in impedance at the other end of the winding portion, and thus reduces occurrence of reflection of the signal at the location.

The term "decrease monotonically" herein means showing no increasing tendency, and refers to monotonic decrease in the wider sense.

Preferably, the inductor component further comprises a core having a spool, and the winding portion is constructed by winding a conducting wire on the spool.

Preferably, the winding portion includes a plurality of conductors wound with a space of a predetermined wire-to-wire distance so as to be magnetically coupled to each other, and winding intervals of the plurality of conductors decrease monotonically from the one end to the other end of the winding portion.

Preferably, the inductor component comprises a laminate body in which a plurality of insulators are laminated together, and a plurality of conductors juxtaposed in a laminate direction of the insulators in the laminate body; the winding portion is constructed by electrically connecting the conductors adjacent in the laminate direction to each other; and intervals in the laminate direction between the plurality of conductors decrease monotonically in the laminate direction.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The preferred embodiments of the present invention will be described below in detail with reference to the accompanying drawings. In the description, the same elements or elements with the same functionality will be denoted by the same reference symbols, without redundant description.

(First Embodiment)

Figure 1:
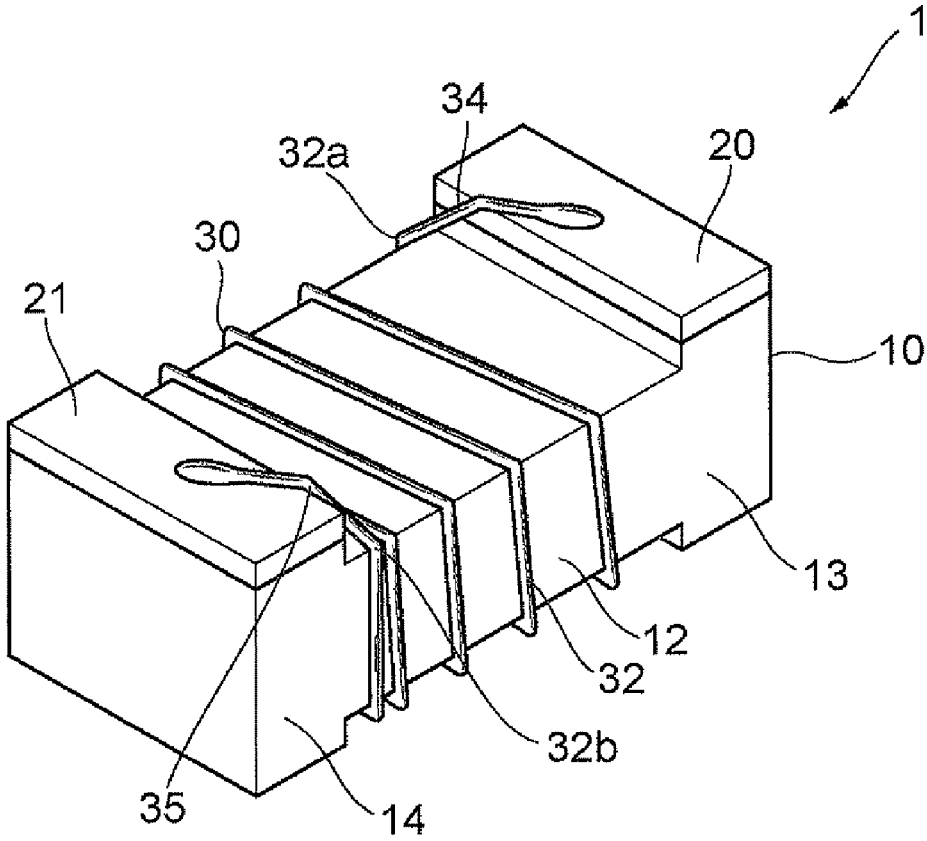
FIG. 1 is a perspective view of an inductor component according to the first embodiment.
Figure 2:
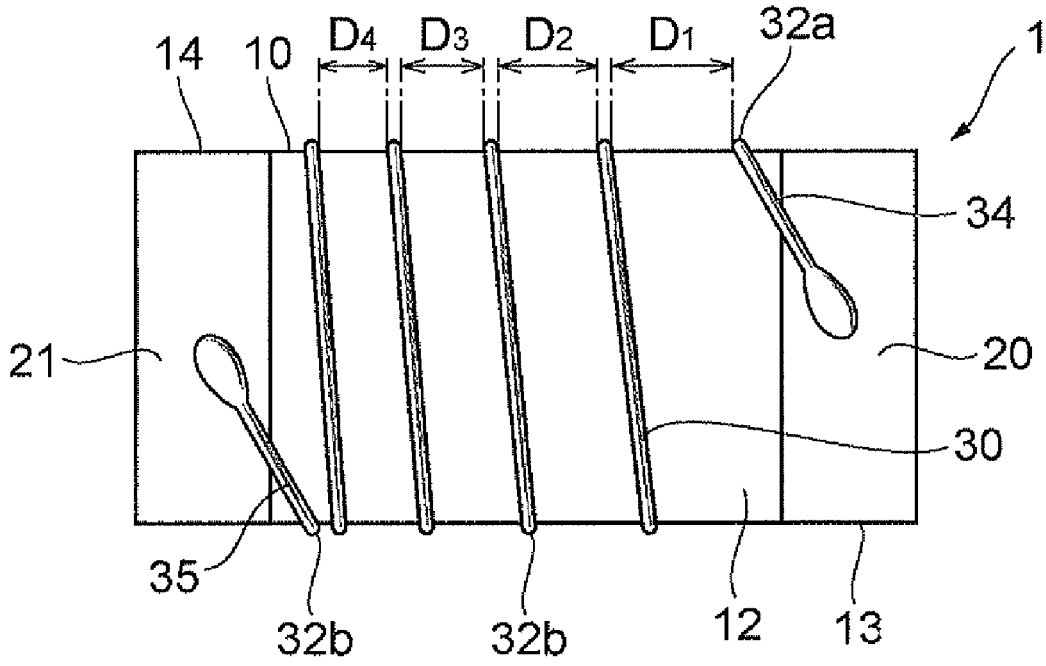
FIG. 2 is a plan view of the inductor component according to the first embodiment.

A configuration of inductor component 1 according to the first embodiment will be described with reference to FIGS. 1 and 2. FIG. 1 is a perspective view of the inductor component of the first embodiment. FIG. 2 is a plan view of the inductor component of the first embodiment.

The inductor component 1, as shown in FIG. 1, has a core 10, electrode portions 20, 21, and a winding 30.

The core 10 is made of a magnetic material (e.g., ferrite or the like) or a nonmagnetic material (e.g., ceramic or the like). The core 10 is a so-called drum core and has a spool portion 12, and a pair of flange portions 13, 14 formed at the axial ends of the spool portion 12. The spool portion 12 is of a quadrangular prism shape. Each flange portion 13, 14 is of a rectangular parallelepiped shape. The spool portion 12 and flange portions 13, 14 are integrally formed. The core 10 is of an H shape in a cross section parallel to the shaft center direction of the spool portion 12.

The electrode portion 20 is located on the flange portion 13 and the electrode portion 21 on the flange portion 14. The electrode portions 20, 21 are formed by transferring an electroconductive paste consisting primarily of a metal material (e.g., silver or the like) onto side faces of the flange portions 13, 14, thereafter firing it at a predetermined temperature (e.g., approximately 700° C.), and further plating the underlying metal layer with metal. The metal plating can be performed, for example, using Ni/Sn, Cu/Ni/Sn, Ni/Au, Ni/Pd/Au, Ni/Pd/Ag, or Ni/Ag. The electrode portions 20, 21 may also be constructed by attaching metal sheets at corresponding positions on the flange portions 13, 14. The metal sheets can be, for example, sheets of phosphor bronze plated with metal (Ni/Sn). The electrode portions 20, 21 may be directly formed on the flange portions 13, 14 by plating.

The winding 30 consists of a conductor wire such as a copper wire coated with insulating film and includes a winding portion 32 in which the conductor wire is wound by three or more turns on the spool portion 12, and lead portions 34, 35 located at both ends 32*a*, 32*b*, respectively, of the winding portion 32. In FIGS. 1 and 2, illustration of the insulating film of the winding 30 is omitted and the core wire as a conductor is illustrated.

The winding portion 32 and lead portions 34, 35 are continuous and the lead portions 34, 35 are connected to the respective ends 32*a*, 32*b* of the winding portion 32. The lead portion 34 is joined at its end to the electrode portion 20, whereby the lead portion 34 is physically and electrically connected to the electrode portion 20. The lead portion 35 is joined at its end to the electrode portion 21, whereby the lead portion 35 is physically and electrically connected to the electrode portion 21. Through these connections, the lead portions 34, 35 connect the winding portion 32 to the electrode portions 20, 21. The connections (joints) between the lead portions 34, 35 and the electrode portions 20, 21 are achieved, for example, by thermal compression bonding, welding, or soldering.

Winding intervals $D_n$ (n=1-4) of the respective turns in the winding portion 32, as shown in FIG. 2, decrease monotonically from one end 32*a* to the other end 32*b* of the winding portion 32. The winding intervals $D_n$ of the respective turns herein are intervals between the aforementioned core wires in the respective turns. In the present embodiment, the relation among the winding intervals $D_n$ (n=1-4) satisfies Formula (1) below and is so-called strictly monotonic decrease.

$$D_1>D_2>D_3>D_4 \quad (1)$$

In the present embodiment, as described above, the winding intervals $D_n$ of the respective turns in the winding portion 32 decrease monotonically from one end 32*a* to the other end 32*b* of the winding portion 32 and, therefore, magnetic conditions are different between adjacent turns. Namely, when the winding portion 32 is assumed to be an aggregate of coils (inductors) each composed of two adjacent turns, magnetic path lengths of the coils become shorter from the one end 32*a* side to the other end 32*b* side of the winding portion 32. For this reason, in the magnetic path formed by the winding portion 32, the impedance of the conductor wire forming the winding portion 32 increases from the one end 32*a* side to the other end 32*b* side of the winding portion 32. As a consequence of this configuration, the impedance is prevented from suddenly varying at the other end 32*b* of the winding portion 32 though it is hard to avoid variation in the impedance at one end 32*a* of the winding portion 32. In the inductor component 1, sudden variation in the impedance is suppressed at the other end 32*b* of the winding portion 32, so as to reduce occurrence of reflection of a signal at the location.

(Second Embodiment)

Figure 3:
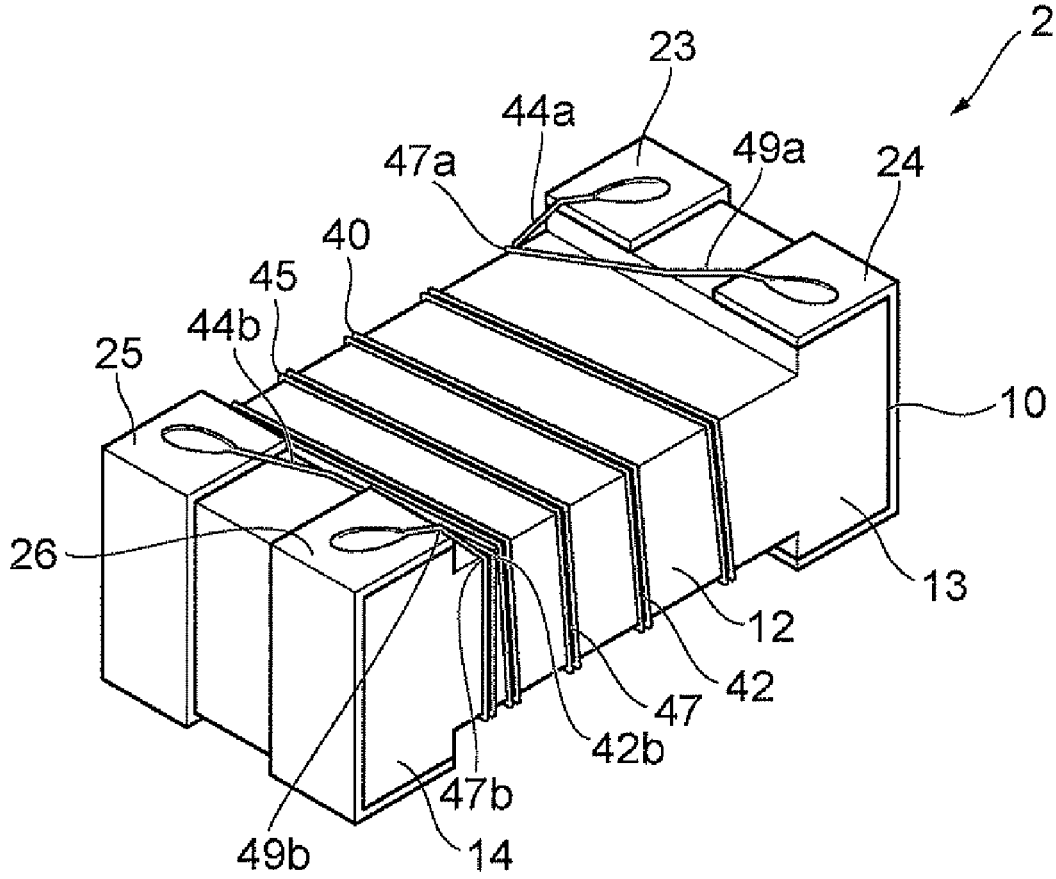
FIG. 3 is a perspective view of an inductor component according to the second embodiment.
Figure 4:
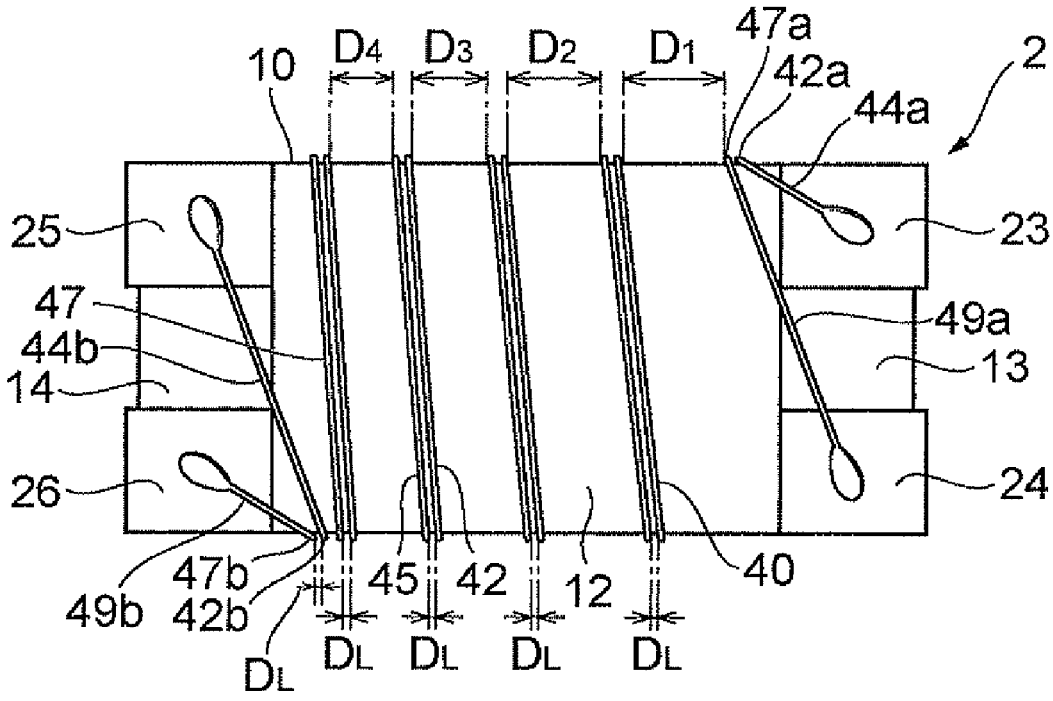
FIG. 4 is a plan view of the inductor component according to the second embodiment.

A configuration of inductor component 2 according to the second embodiment will be described with reference to FIGS. 3 and 4. FIG. 3 is a perspective view of the inductor component of the second embodiment. FIG. 4 is a plan view of the inductor component of the second embodiment.

The inductor component 2, as shown in FIG. 3, has a core 10, electrode portions 23-26, and two windings 40, 45. The inductor component 2 constitutes a so-called common-mode choke coil.

The electrode portions 23, 24 are located on the flange portion 13 and the electrode portions 25, 26 on the flange portion 14. The electrode portions 23-26 are made in the same manner as the electrode portions 20, 21 in the first embodiment are.

Each of the windings 40, 45 consists of a conductor wire such as a copper wire coated with insulating film as the winding 30 in the first embodiment does. In FIGS. 3 and 4, illustration of the insulating film of the windings 40, 45 is omitted and the core wires as conductors are illustrated. Each winding 40, 45 includes a winding portion 42, 47 in which the conductor is wound by three or more turns on the spool portion 12, and lead portions 44*a*, 44*b*; 49*a*, 49*b* located at the both ends 42*a*, 42*b*; 47*a*, 47*b* of the winding portion 42, 47. The winding portion 42, 47 and the lead portions 44*a*, 44*b*; 49*a*, 49*b* are continuous and the lead portions 44*a*, 44*b*, 49*a*, and 49*b* are connected to the ends 42*a*, 42*b*, 47*a*, and 47*b*, respectively, of the winding portions 42, 47.

The lead portions 44*a*, 44*b*, 49*a*, and 49*b* are also connected to the respective electrode portions 23-26. The lead portion 44*a* is joined at its end to the electrode portion 23, whereby the lead portion 44*a* is physically and electrically connected to the electrode portion 23. The lead portion 44*b* is joined at its end to the electrode portion 25, whereby the lead portion 44*b* is physically and electrically connected to the electrode portion 25. Through these connections, the lead portions 44*a*, 44*b* connect the winding portion 42 to the electrode portions 23, 25. The lead portion 49*a* is joined at its end to the electrode portion 24, whereby the lead portion 49*a* is physically and electrically connected to the electrode portion 24. The lead portion 49*b* is joined at its end to the electrode portion 26, whereby the lead portion 49*b* is physically and electrically connected to the electrode portion 26. Through these connections, the lead portions 49*a*, 49*b* connect the winding portion 47 to the electrode portions 24, 26. The connections (joints) between the lead portions 44*a*, 44*b*, 49*a*, 49*b* and the electrode portions 23-26 are achieved, for example, by thermal compression bonding, welding, or soldering.

In the winding portions 42, 47, as shown in FIG. 4, the two conductor wires are wound with a space of a predetermined wire-to-wire distance ($D_L$) so as to be magnetically coupled to each other. The winding intervals $D_n$ (n=1-4) of the respective turns in the winding portions 42, 47 decrease monotonically (strictly monotonic decrease) from one ends 42*a*, 47*a* to the other ends 42*b*, 47*b* of the winding portions 42, 47. Namely, the relation among the winding intervals $D_n$ (n=1-4) satisfies Formula (1) above. The winding intervals $D_n$ of the respective turns herein are also intervals between the aforementioned core wires in the respective turns.

In the present embodiment, as described above, the winding intervals $D_n$ of the respective turns in the winding portions 42, 47 decrease monotonically from one ends 42*a*, 47*a* to the other ends 42*b*, 47*b* of the winding portions 42, 47, and, therefore, magnetic conditions are different between adjacent turns. Namely, when each winding portion 42, 47 is assumed to be an aggregate of coils (inductors) each composed of two adjacent turns, the magnetic path lengths of the coils become shorter from the one end 42*a*, 47*a* side to the other end 42*b*, 47*b* side of the winding portions 42, 47. For this reason, in the magnetic path formed by each winding portion 42, 47, the impedance of the conductor wire forming the winding portion 42, 47 increases from the one end 42*a*, 47*a* side to the other end 42*b*, 47*b* side of the winding portion 42, 47. As a consequence of this configuration, the impedance is prevented from suddenly varying at the other ends 42*b*, 47*b* of the winding portions 42, 47 though it is hard to avoid variation in the impedance at one ends 42*a*, 47*a* of the winding portions 42, 47. In the inductor component 2, sudden variation in the impedance is suppressed at the other ends 42*b*, 47*b* of the winding portions 42, 47, so as to reduce occurrence of reflection of a signal at the location.

(Third Embodiment)

Figure 5:
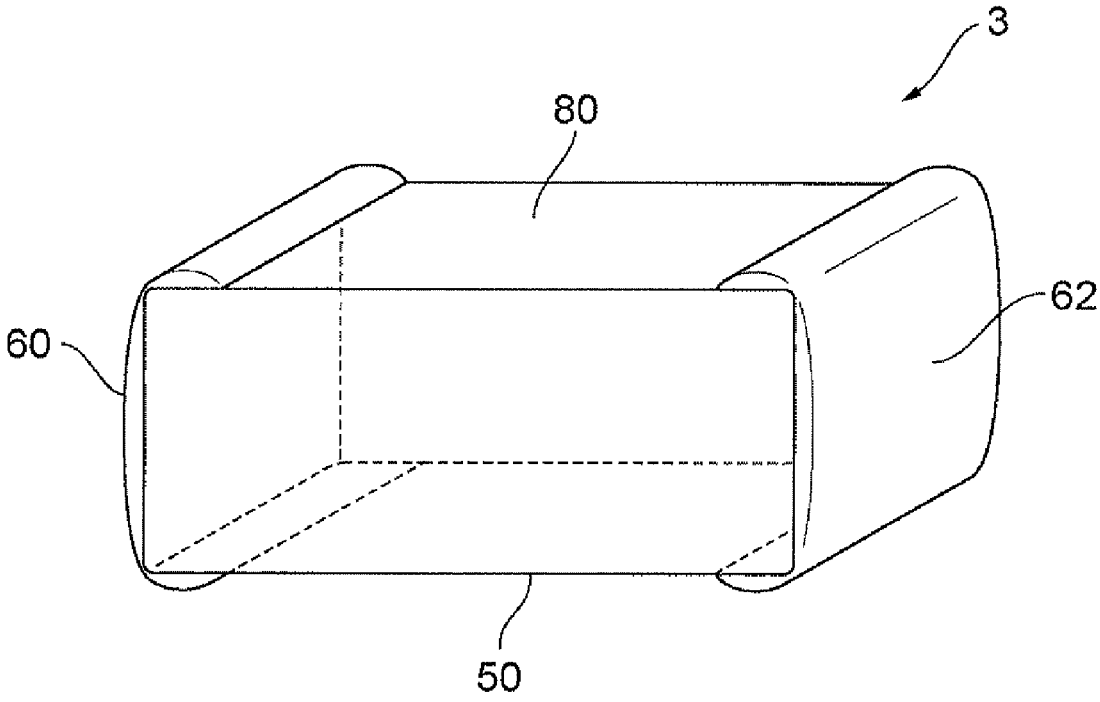
FIG. 5 is a perspective view of an inductor component according to the third embodiment.
Figure 6:
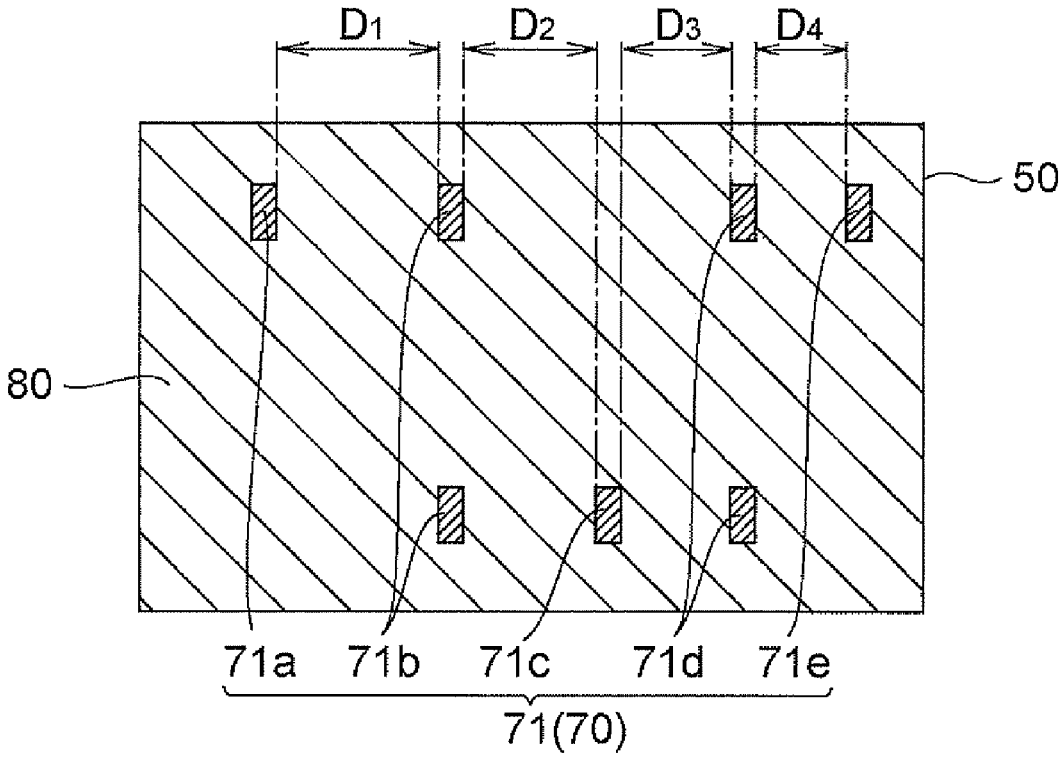
FIG. 6 is a drawing to illustrate a sectional configuration of an element included in the inductor component of the third embodiment.
Figure 7:
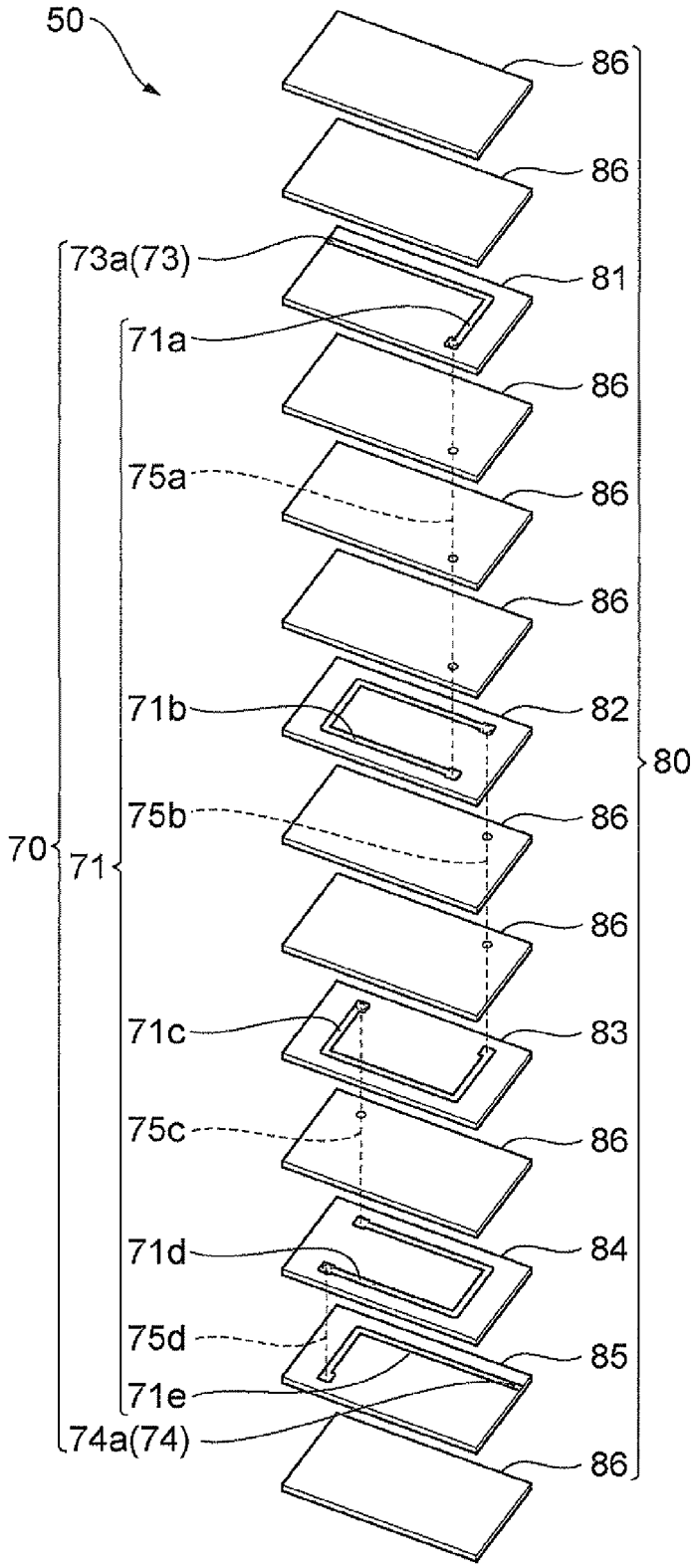
FIG. 7 is an exploded perspective view showing the element included in the inductor component of the third embodiment.

A configuration of inductor component 3 according to the third embodiment will be described with reference to FIGS. 5 to 7. FIG. 5 is a perspective view of the inductor component of the third embodiment. FIG. 6 is a drawing to illustrate a sectional configuration of an element included in the inductor component of the third embodiment. FIG. 7 is an exploded perspective view showing the element included in the inductor component of the third embodiment.

The inductor component 3, as shown in FIG. 5, has an element 50 of a rectangular parallelepiped shape, and a pair of electrode portions (terminal electrodes) 60, 62. The inductor component 3 constitutes a so-called multilayer inductor.

The element 50, as shown in FIGS. 6 and 7, has a coil portion 70 and an exterior portion 80. The coil portion 70 includes a coiled conductor 71, and lead conductors 73, 74 located at two ends of the coiled conductor 71. The exterior portion 80 includes a plurality of insulator layers 81-86 laminated together. Each insulator layer 81-86 is composed, for example, of a sintered body of a ceramic green sheet containing a magnetic material (e.g., Ni—Cu—Zn ferrite or the like), or a sintered body of a ceramic green sheet containing a nonmagnetic material (e.g., Cu—Zn ferrite or the like). In a practical inductor component 3, the insulator layers 81-86 are integrally formed so that no boundary can be visually recognized between them.

Each electrode portion 60, 62 is arranged on an outside surface of the element 50. Each electrode portion 60, 62 is formed, for example, by applying an electroconductive paste containing electroconductive metal powder and glass frit, onto the exterior surface of the element 50 and firing it. A plated layer may be formed on the electrodes formed by firing, if necessary.

The coiled conductor 71 is composed of conductor patterns 71*a*-71*e* formed on the insulator layers 81-85. The lead conductors 73, 74 are composed of conductor patterns 73*a*, 74*a*, respectively, formed on the insulator layers 81, 85. In the present embodiment, the conductor pattern 71*a* and the conductor pattern 73*a* are integrally and continuously formed, and the conductor pattern 71*e* and the conductor pattern 74*a* are integrally and continuously formed. The conductor patterns 71*a*-71*e*, 73*a*, and 74*a* are made of an electroconductive material (e.g., Ag, Pd, an alloy of these, or the like). The conductor patterns 71*a*-71*e*, 73*a*, and 74*a* are constructed as sintered bodies of an electroconductive paste containing the foregoing electroconductive material.

The conductor pattern 71*a* corresponds to approximately half of a turn of the coiled conductor 71 and extends in a near L shape on the insulator layer 81. The conductor pattern 71*b* corresponds to approximately three quarters of a turn of the coiled conductor 71 and extends in a near U shape on the insulator layer 82. The conductor pattern 71*c* corresponds to approximately three quarters of a turn of the coiled conductor 71 and extends in a near C shape on the insulator layer 83. The conductor pattern 71*d* corresponds to approximately three quarters of a turn of the coiled conductor 71 and extends in near U-shape on the insulator layer 84. The conductor pattern 71*e* corresponds to approximately half of a turn of the coiled conductor 71 and extends in a near L shape on the insulator layer 85. The conductor patterns 71*a*-71*e* are juxtaposed in the laminate direction of the insulator layers 81-86.

The conductor patterns 71*a*-71*e* are electrically connected at their ends to each other through penetrating electrodes 75*a*-75*d* formed in the insulator layers 81-84, 86. The conductor patterns 71*a*-71*e* constitute the coiled conductor 71 in the configuration wherein the conductor patterns 71*a*-71*e* adjacent in the laminate direction of the insulator layers 81-86 are electrically connected to each other. As the coiled conductor 71 is so constructed, the conductor is wound by three or more turns.

The lead conductor 73*a* extends in a near I shape continuously from one end of the conductor pattern 71*a* on the insulator layer 81. One end of the conductor pattern 73*a* is exposed in the exterior surface of the element 50. The conductor pattern 73*a* is physically and electrically connected to the electrode portion 60. The conductor pattern 74*a* extends in a near I shape continuously from the other end of the conductor pattern 71*e* on the insulator layer 85. The other end of the conductor pattern 74*a* is exposed in the exterior surface of the element 50. The conductor pattern 74*a* is physically and electrically connected to the electrode portion 62.

There are three insulator layers 86 without any conductor pattern between insulator layer 81 and insulator layer 82. There are two insulator layers 86 without any conductor pattern between insulator layer 82 and insulator layer 83.

There is one insulator layer 86 without any conductor pattern between insulator layer 83 and insulator layer 84. This configuration adjusts the spaces between the conductor patterns 71*a*-71*e* in the laminate direction of the insulator layers 81-86.

Winding intervals of the respective turns (conductor patterns 71*a*-71*e*) in the coiled conductor 71 correspond to intervals $D_n$ (n=1-4) of the conductor patterns 71*a*-71*e* in the laminate direction of the insulator layers 81-86. The intervals $D_n$ (n=1-4) of the conductor patterns 71*a*-71*e* in the laminate direction of the insulator layers 81-86 decrease monotonically from one end to the other end of the coiled conductor 71, as shown in FIG. 6. Namely, the relation among the winding intervals $D_n$ (n=1-4) satisfies the aforementioned Formula (1).

In the present embodiment, as described above, the winding intervals $D_n$ of the respective turns in the coiled conductor 71 decrease monotonically from one end to the other end of the coiled conductor 71 and, therefore, magnetic conditions are different between adjacent turns. Namely, when the coiled conductor 71 is assumed to be an aggregate of coils (inductors) each composed of two adjacent turns, the magnetic path lengths of the coils become shorter from the one end side to the other end side of the coiled conductor 71. For this reason, in the magnetic path formed by the coiled conductor 71, the impedance of the conductor forming the coiled conductor 71 increases from the one end side to the other side of the coiled conductor 71. As a consequence of this configuration, the impedance is prevented from suddenly varying at the other end of the coiled conductor 71 though it is hard to avoid variation in the impedance at one end of the coiled conductor 71. In the inductor component 3, sudden variation in the impedance is suppressed at the other end of the coiled conductor 71, so as to reduce occurrence of reflection of a signal at the location.

The following will specifically explain the effect of suppressing the variation in impedance to reduce reflection of the signal by the embodiments of the present invention. The impedance of the inductor component herein is measured by TDR (Time Domain Reflectometry). The TDR is a measurement method for measuring the characteristic impedance of a transmission line in such a manner that a step pulse is fed onto the transmission line and that a pulse reflected at a discontinuous portion of the characteristic impedance is measured.

Figure 8:
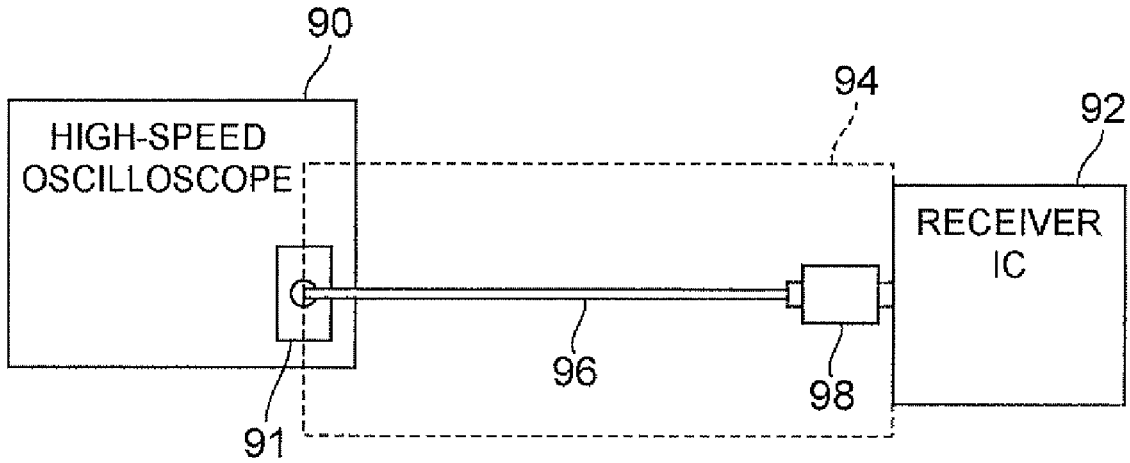
FIG. 8 is a drawing for explaining a measurement environment by TDR.

First, a measurement environment by TDR will be described based on FIG. 8. In the measurement environment shown in FIG. 8, a high-speed oscilloscope 90 and a receiver IC 92 are connected through a transmission line 94. The transmission line 94 has a cable 96 and an inductor component 98. The high-speed oscilloscope 90 has a TDR module 91. The high-speed oscilloscope 90 is connected through the TDR module 91 to the cable 96 and the other end of the cable 96 is connected to the inductor component 98. The receiver IC 92 is connected to the other end of the inductor component 98.

The high-speed oscilloscope 90 used herein is the Agilent 86100 wide-bandwidth oscilloscope available from Agilent Technologies, Inc. The TDR module 91 used herein is the 54754 differential TDR plug-in module available from Agilent Technologies, Inc. The receiver IC 92 has the input impedance of infinity with power being off, to cause 100% reflection of a signal from the high-speed oscilloscope 90. The transmission line 94 has the characteristic impedance of 50Ω.

Figure 9:
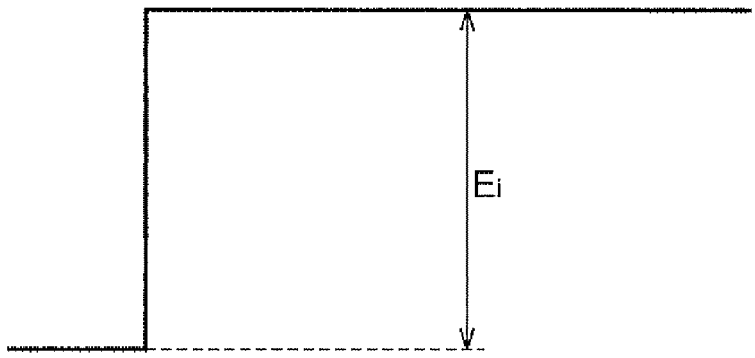
FIG. 9 is a drawing for explaining a measurement method by TDR.
Figure 9:
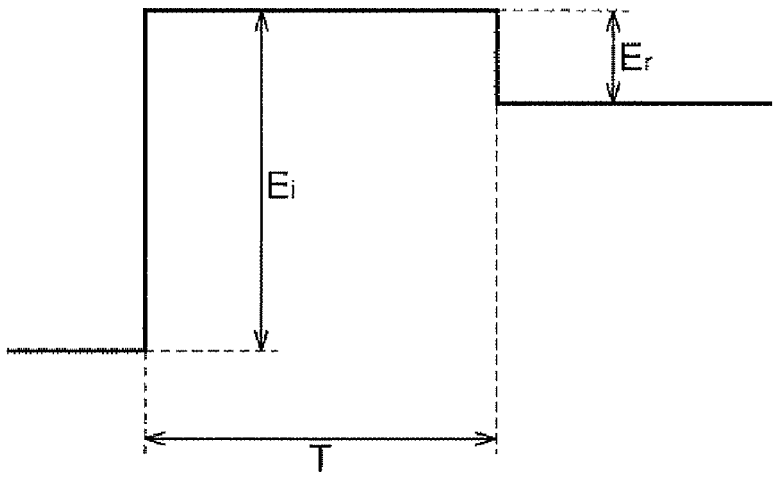

Next, the measurement method by TDR will be described based on FIGS. 8 and 9. First, the high-speed oscilloscope 90 generates an input voltage step Ei and outputs this input voltage step Ei onto the transmission line 94. When there is no discontinuous point of characteristic impedance on the transmission line 94, the input voltage step Ei is reflected by the receiver IC 92 as it is, and only the input voltage step Ei is displayed, as shown in FIG. 9(*a*), on the high-speed oscilloscope 90.

On the other hand, when there is a discontinuous portion of characteristic impedance on the transmission line 94, a part of the input voltage step is reflected at the discontinuous portion. In this case, a reflected wave Er is algebraically added onto the input voltage step Ei and they are displayed, as shown in FIG. 9(*b*), on the high-speed oscilloscope 90. From this result, we can determine the position of the discontinuous portion of impedance and the value of characteristic impedance. Specifically, the position of the discontinuous portion of impedance can be determined from a time T to measurement of the reflected wave Er and the impedance at the discontinuous portion can be determined from the value of the reflected wave Er.

Figure 10:
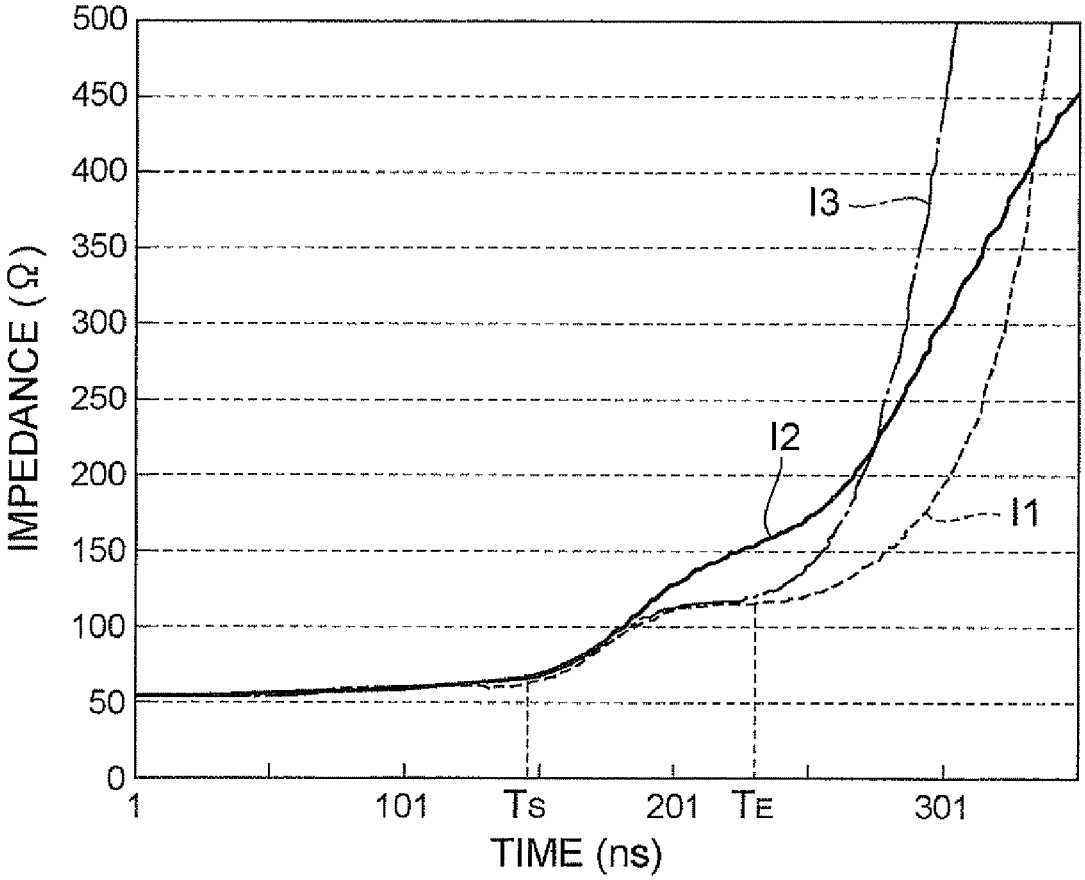
FIG. 10 is a diagram showing the measurement results by TDR.

The measurement results are shown in FIG. 10. The inductor component 98 used herein was selected from the inductor component of the conventional technology, i.e., the inductor component in which the winding intervals of the respective turns in the winding portion were equally-spaced intervals, and the inductor component 1 of the first embodiment described above. The configuration of the inductor component of the conventional technology and the configuration of the inductor component 1 were the same except for the winding intervals of the respective turns in the winding portion. In the inductor component of the conventional technology, the winding intervals of the respective turns were 0.1 mm. In the inductor component 1, the winding interval D1 was 2.0 mm and the winding intervals were decreased by 0.6 mm per turn. The winding intervals of the respective turns herein are also the aforementioned intervals between core wires in the respective turns.

Characteristic I1 is the result of the measurement where the inductor component 98 is the inductor component of the conventional technology. As seen from the characteristic I1, the impedance varies at one end of the winding portion (position indicated by "$T_S$" in FIG. 10) and the impedance also significantly varies at the other end of the winding portion (position indicated by "$T_E$" in FIG. 10).

Characteristic I2 is the result of the measurement where the inductor component 98 is the inductor component 1 of the first embodiment, the electrode portion 20 is connected to the cable 96, and the electrode portion 21 is connected to the receiver IC 92. As seen from the characteristic I2, it is hard to avoid variation in impedance at one end 32*a* of the winding portion 32 (position indicated by "$T_S$" in FIG. 10), but sudden variation in impedance is suppressed at the other end 32*b* of the winding portion 32 (position indicated by "$T_E$" in FIG. 10). It is seen from the characteristic I2 that the impedance increases gradually in the winding portion 32.

Characteristic I3 is the result of the measurement where the inductor component 98 is the inductor component 1 of the first embodiment, the electrode portion 21 is connected to the cable 96, and the electrode portion 20 is connected to the receiver IC 92. As seen from the characteristic I3, the impedance varies at one end of the winding portion (position indicated by "$T_S$" in FIG. 10) and the impedance also suddenly varies at the other end of the winding portion (position indicated by "$T_E$" in FIG. 10), as in the case of the inductor component of the conventional technology.

Figure 11:
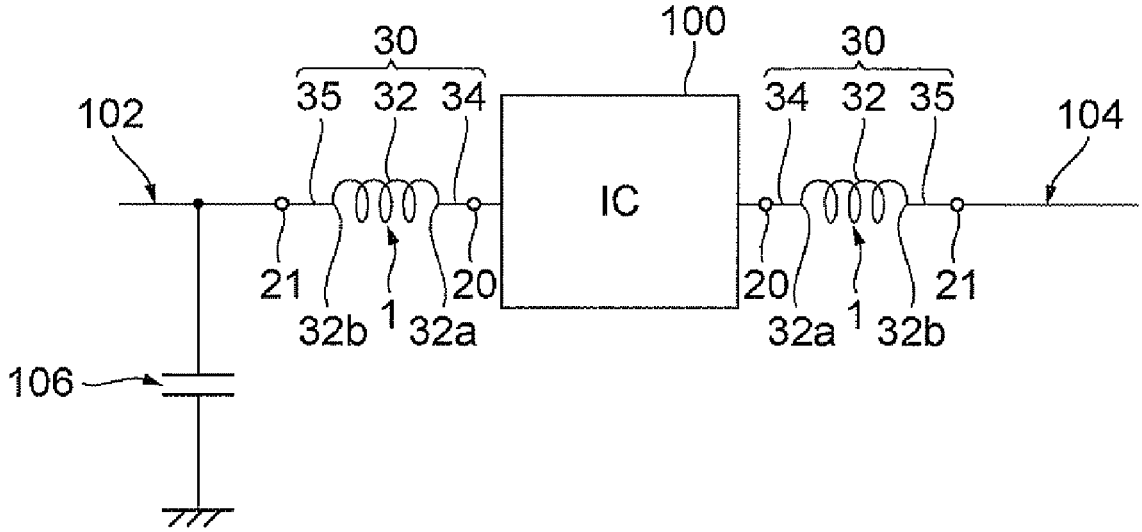
FIG. 11 is a circuit diagram for explaining a mounted structure of inductor components according to an embodiment of the present invention.

The below will describe a mounted structure of inductor components according to an embodiment of the present invention, with reference to FIG. 11. FIG. 11 is a circuit diagram for explaining the mounted structure of inductor components according to the present embodiment. The mounted structure herein will be described using the inductor component 1 of the first embodiment as the inductor components to be mounted, but it should be noted that the inductor components 2, 3 of the other embodiments can also be mounted similarly.

As shown in FIG. 11, the inductor components 1 are inserted, one in power line 102 to IC 100 and the other in output line (e.g., a clock line or signal line) 104 from IC 100. The inductor component 1 inserted in the power line 102, and a capacitor 106 constitute an LC filter.

In the inductor component 1 inserted in the power line 102, the electrode portion 20 is connected to IC 100. In the inductor component 1 inserted in the output line 104, the electrode portion 20 is also connected to IC 100.

In IC 100, switching is performed at high speed inside and noise is likely to be superposed on the power line 102, the output line 104, and so on. However, since reflection is reduced in the inductor components 1 as described above, there is less superposition of noise generated in IC 100. In the inductor component of the conventional technology, significant reflection occurs in the inductor component, and there is considerable superposition of noise generated in IC 100. As inferred from the above measurement results, where the electrode portion 21 is connected to IC 100, significant reflection also occurs in the inductor components 1 and there is considerable superposition of noise generated in IC 100.

The above explained the preferred embodiments of the present invention, but it is noted that the present invention is by no means limited to the aforementioned embodiments and that the present invention can be modified in various ways without departing from the spirit and scope of the invention.

The first and second embodiments adopt the drum core as core 10, but, without having to be limited to it, a toroidal core may also be adopted. The core 10 does not always have to be provided, but the inductor component may be an air-core inductor component without any spool. The air-core inductor component is suitably applicable as a high-frequency coil. The inductor component 1 of the first embodiment is suitably applicable as a choke coil, a signal rectifying coil, or an antenna coil when the core 10 is made of a magnetic material. When the core 10 is made of a nonmagnetic material, the inductor component 1 is suitably applicable as a high-frequency coil.

The number of turns in each of the winding portions 32, 42, 47 or in the coiled conductor 71 does not have to be limited to those in the aforementioned embodiments as long as the turns are three or more turns.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An inductor component comprising:

electrode portions;

a winding portion in which a conductor is wound by three or more turns;

lead portions located at both ends of the winding portion and connecting the winding portion and the electrode portions; and a laminate body in which a plurality of insulators are laminated together, wherein winding intervals of respective turns in the winding portion decrease monotonically from one end to an other end of the winding portion, wherein the inductor component is mounted in an inductor component mounting structure in a power line to an IC or in an output line from the IC, wherein an electrode portion of the electrode portions connected to the one end of the winding portion via the lead portion is connected to the IC, wherein the conductor includes a plurality of conductors juxtaposed in a laminate direction of the insulators in the laminate body, wherein the winding portion is constructed by electrically connecting adjacent conductors of the plurality of conductors in the laminate direction to each other, and wherein intervals in the laminate direction between the plurality of conductors decrease monotonically in the laminate direction.

* * * * *